United States Patent [19]

Koffel

[11] Patent Number: 4,589,823

[45] Date of Patent: May 20, 1986

[54] ROTOR BLADE TIP

[75] Inventor: William K. Koffel, Cincinnati, Ohio

[73] Assignee: General Electric Company, Cincinnati, Ohio

[21] Appl. No.: 604,671

[22] Filed: Apr. 27, 1984

[51] Int. Cl.[4] ..... F01D 5/20

[52] U.S. Cl. ..... 416/92; 415/172 A; 415/174; 416/224; 416/241 B

[58] Field of Search ..... 416/92, 97 R, 97 A, 416/96 R, 96 A, 224, 228, 23 L, 241 R, 241 B; 415/172 A, 174

[56] References Cited

U.S. PATENT DOCUMENTS

| | | | |
|---|---|---|---|
| 3,810,711 | 5/1974 | Emmerson et al. | 416/97 R |
| 3,854,842 | 12/1974 | Caudill | 416/228 X |
| 3,899,267 | 8/1975 | Dennis et al. | 416/92 |
| 3,981,609 | 9/1976 | Koenig | 415/117 |
| 3,993,414 | 11/1976 | Meauze et al. | 415/181 |
| 4,050,845 | 9/1977 | Gemein et al. | 415/172 A |
| 4,067,662 | 1/1978 | Rossmann | 416/97 A |
| 4,142,824 | 3/1979 | Andersen | 416/97 R X |
| 4,232,995 | 11/1980 | Stalker et al. | 415/172 A |
| 4,247,254 | 1/1981 | Zelahy | 415/172 A |
| 4,390,320 | 6/1983 | Eiswerth | 416/97 R |
| 4,411,597 | 10/1983 | Koffel et al. | 416/92 |
| 4,440,834 | 4/1984 | Aubert | 416/96 R X |
| 4,487,550 | 12/1984 | Horvath et al. | 416/92 |

FOREIGN PATENT DOCUMENTS

| | | | |
|---|---|---|---|
| 1002324 | 3/1952 | France | 416/92 |
| 2105415 | 3/1983 | United Kingdom | 416/97 R |

*Primary Examiner*—Everette A. Powell, Jr.

*Attorney, Agent, or Firm*—Douglas S. Foote; Derek P. Lawrence

[57] ABSTRACT

An improved blade tip with an abrasive coating is disclosed. The blade tip is included in a rotor blade which is rotatable with respect to a stationary surface. The tip has a contour which is effective for producing a normal loading component on the coating if the tip contacts the surface while rotating. In a specific form of the present invention, the tip comprises an end wall extending radially outwardly from the perimeter of the outer end of the rotor blade and a concave surface bounded by the end walls and extending radially inwardly therefrom.

6 Claims, 5 Drawing Figures

ROTOR BLADE TIP

This invention relates generally to turbomachinery blades and, more particularly, to an improved blade tip with an abrasive coating.

BACKGROUND OF THE INVENTION

Axial flow turbomachinery typically includes one or more rotating assemblies or disks. Each disk contains a number of radially directed blades. Each such bladed disk is rotatable with respect to a stationary surface or shroud which circumferentially surrounds each disk. The radially outer end or tip of each blade forms a narrow gap or clearance with respect to the shroud. Ideally, such gap should not exist. However, in practice, the bladed rotor and concentric shroud do not form invariant and perfectly circular shapes. Various forces acting thereon create distortions. For example, temperature changes create differential rates of thermal expansion and contraction on the rotor and shroud which may result in rubbing between the blade tips and shrouds. In addition, centrifugal forces acting on the blades and structural forces acting on the shroud create distortions thereon which may result in rubs.

Such rubs result in deterioration of the blade tips and/or shroud surface thereby increasing the average gap, hereinafter referred to as tip clearance. Increases in tip clearance result in significant decreases in the gas turbine engine efficiency, and hence in fuel burned.

Generally, the blade tips, prior to assembly within the casing, may be shaped to within very narrow tolerances with respect to blade length affecting tip clearance. In contrast, casing out of roundness and eccentricities between the rotor and shroud axes are difficult to avoid especially during engine operation. Thus, during certain periods of engine operation the blade tips may contact the shroud in certain interference regions. If the blade tips are made sacrificial and are worn away by contact in such regions, the average tip clearance in the non-interfering regions increases thereby reducing engine efficiency. However, if the blade tip has an abrasive coating, the shroud may be cut away in the interfering regions and the gap in the non-interfering regions will not be affected.

In either situation, some wearing of the blade tips is inevitable. In order to accomodate blade rubs without deleterious effects of rubs on blades, it is known to utilize "squealers" on the radially outer end of the blade. The "squealers" typically are elongated extensions of the airfoil and are essentially a long thin fin which cracks easily and is difficult to cool.

As noted above, it is also known to use abrasive coatings on blade tips. For example, U.S. Pat. No. 4,232,995-Stalker et al and U.S. Pat. No. 4,390,320-Eiswerth disclose blade tips with abrasive coatings. Such blade tips have proven effective for their intended purpose. However, assuring a good bond between the abrasive coating and the blade tip is critical. Blade tip rubs tend to occur quickly and produce a shear force on the coating. Prior art blades rely upon the strength of the bonding between the abrasive coating and the blade tip to resist such forces.

OBJECTS OF THE INVENTION

It is an object of the present invention to provide a new and improved rotor blade tip.

It is another object of the present invention to provide a rotor blade tip with abrasive coating having an increased resistance to shear forces.

It is a further object of the present invention to provide a rotor blade tip configured so as to improve cooling thereof.

SUMMARY OF THE INVENTION

In the present invention, a rotor blade includes an improved blade tip with an abrasive coating. The blade is rotatable with respect to a stationary surface. The tip has a contour which is effective for producing a normal loading component on the coating if the tip contacts the surface while rotating.

According to one form of the present invention, the blade tip has an end wall extending radially outwardly from the outer end of the blade and terminating in a generally flat surface. The tip further includes a concave surface, bounded by the end wall.

DETAILED DESCRIPTION OF THE INVENTION

Figure 1:
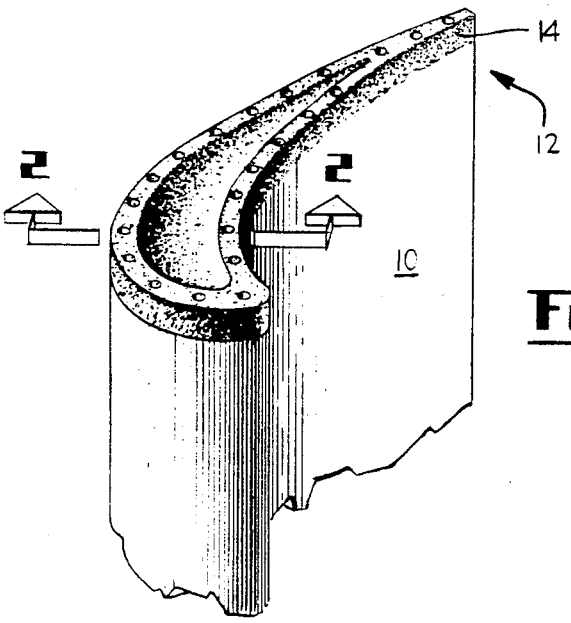
FIG. 1 is a fragmentary perspective view of a turbomachinery blade and tip according to one form of the present invention.

FIG. 1 shows a rotor blade 10 according to one form of the present invention. At the radially outer end of blade 10, a blade tip 12 with an abrasive coating 14 is disposed. Various abrasive materials are known in the art and may be advantageously employed in a coating. For example, cubic boron nitride or aluminum oxide may be used.

Figure 2:
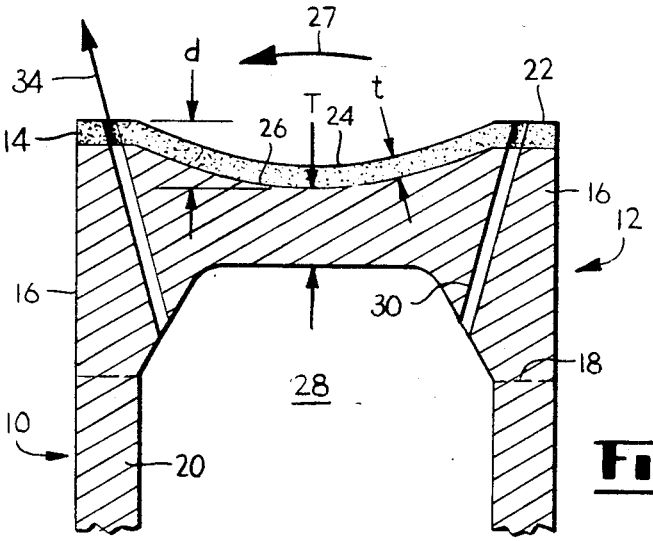
FIG. 2 is a cross-sectional view taken along the line 2—2 in FIG. 1.

FIG. 2 is a fragmentary, cross-sectional view of blade 10 shown in FIG. 1. Blade tip 12 is disposed radially outwardly from outer end 20 of blade 10 and includes an end wall 16 which extends radially outwardly from the perimeter 18 of the radially outer end 20. End wall 16 extends around the periphery of blade 10 and terminates in a generally flat surface 22. Blade tip 12 also includes a concave surface 24 bounded by end wall 16 and extending radially inwardly. Concave surface 24 is continuous with flat surface 22. When installed in a turbomachine, blade 10 is rotatable with respect to a shroud or stationary surface (not shown) so that blade tip 12 is proximate thereto.

The maximum depth "d" of concave surface 24 below a reference plane containing flat surface 22 may vary depending upon the particular application and the amount of anticipated rubbing between blade tip 12 and the surrounding shroud. In general, the thickness "t" of the abrasive coating 14 will be relatively small to prevent large temperature differences between concave surface 24 and interface 26. The applicable thickness of abrasive coating 14 may vary depending on the abrasive selected and the methods used for bonding it to the blade tip. If the effective thermal conductivity of the coating 14 is low, too great a thickness may cause spalling or flaking from thermal stresses. If the coating is too thin, the bond at interface 26 may be weakened by excessive temperature. According to a preferred embodiment of the present invention, the thickness "t" of coating 14 will be between 5 and 30 mils.

Another feature of the present invention is the means for cooling blade tip 12. As shown, blade 10 has an internal cooling passage 28 wherein fluid is circulated to provide blade cooling. Means for cooling blade tip 12 include conduits 30 which conduct a portion of the cooling fluid from passage 28 through end wall 16 and exiting through flat surface 22. In prior art blade tips, for example those known as "squealer tips", the end wall regions are elongated and generally too thin to receive a conduit as in the present invention. The minimum thickness "T" between cooling passage 28 and interface 26 is relatively thin to take advantage of strong convective cooling in cooling passage 28. In a preferred embodiment, this dimension will be between 50 and 65 mils.

Figure 3:
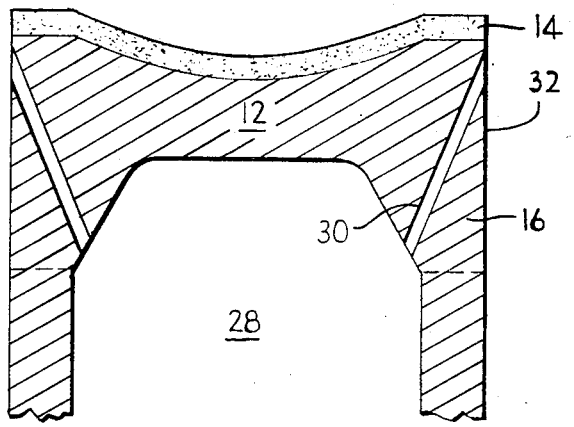
FIG. 3 is a cross-sectional view of a blade tip according to an alternative form of the present invention.

An alternate form of the present invention is shown in FIG. 3. Conduits 30 extend from cooling passage 28 to the outer surface 32 of end wall 16. Preferably, conduit 30 will exit from end wall 16 at a point just below coating 14. The embodiment shown in FIG. 3 may be slightly less effective for providing convective cooling throughout blade tip 12, but may have less tendency to be smeared shut during rubs with the shroud. Referring again to the embodiment shown in FIG. 2, conduits 30 define a direction, shown by arrow 34, which is nearly normal to flat surfce 22. This angle results in a lower stress concentration at the conduit exit than that shown in FIG. 3.

Figure 4A:
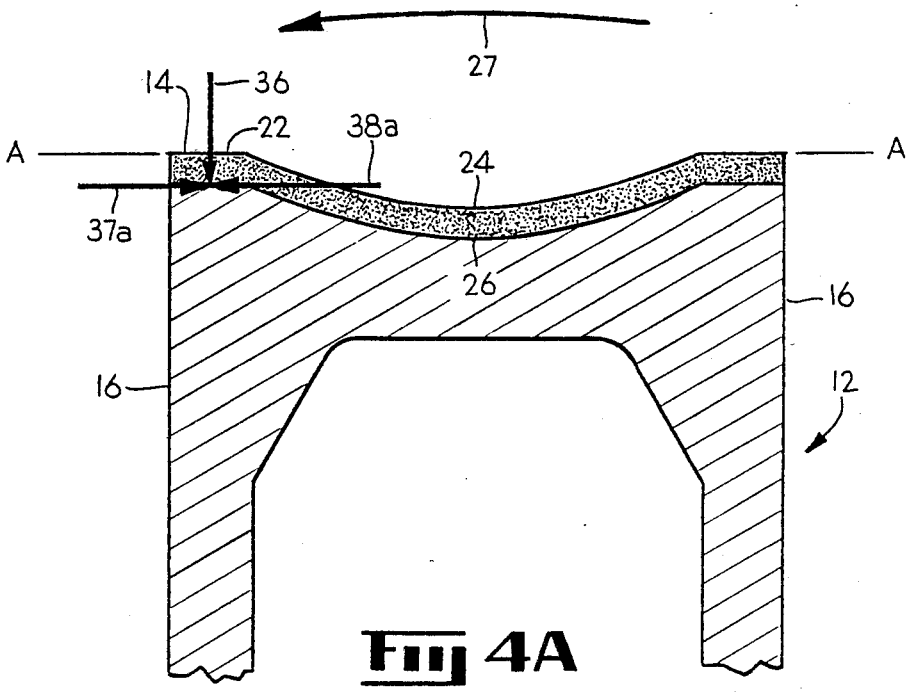
FIGS. 4A and 4B are views of a blade tip similar to that shown in FIG. 2.

In operation, blade 10 rotates in the direction shown in FIG. 4A by arrow 27. As blade tip 12 comes in contact with the surrounding shroud (not shown), abrasive coating 14 will cut a trench therein. At the same time, abrasive coating 14 will wear down. As this wearing occurs, the shroud will contact flat surface 22 so as to produce a normal loading component 36 on bonding surface or interface 26 and a loading component **37*a* tangential and opposite in direction to blade rotation 27. The tangential loading component 37*a* is resisted by internal shear forces 38*a* arising in the abrasive coating 14 along the bonding surface 26. The tangential loading component 37*a* continues to be parallel to bond surface 26, between abrasive coating 14 and end wall 16, until wearing reaches plane A-A. In addition, as wearing occurs above plane A-A, concave surface 24 wil not make contact with the surrounding shroud. However, concave surface 24 is effective for providing a relatively large bonding surface 26 in comparison to the area of wearing surface 22. Thus, the resisting shear per unit area along the bonding surface 26 is reduced making a good bond between the abrasive coating 14 and the blade tip 12** less critical.

Figure 4B:
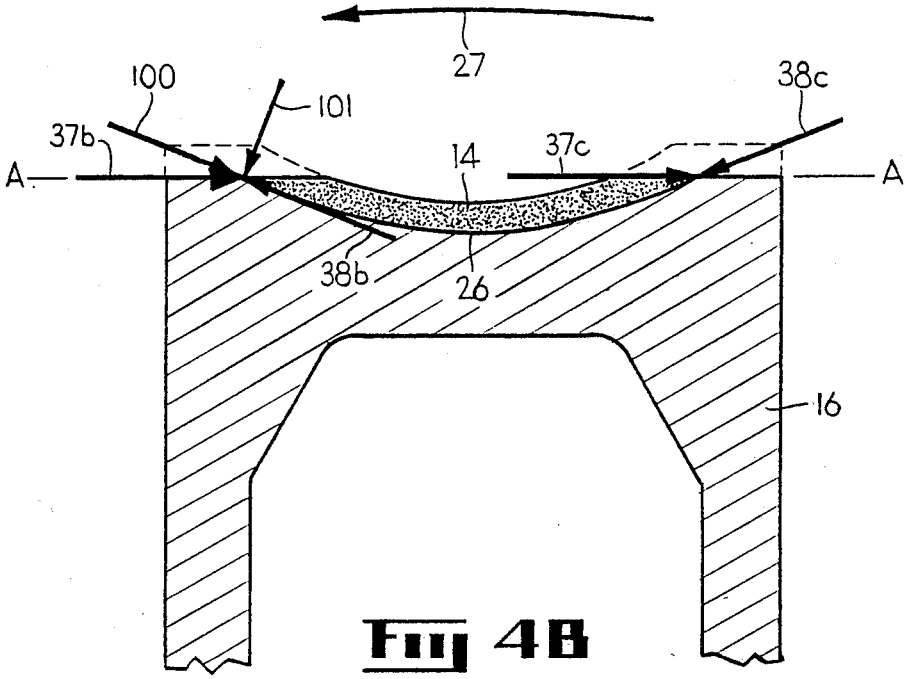

Below plane A-A, as shown in FIG. 4B, the bonding surface 26 is at an angle to the tangential loading component **37*b*. The tangential loading component can be resolved into components acting parallel 100 and normal 101 to the bonding surface 26. Thus, the resisting shear 38*b* acting along the bonding surface 26 is reduced. In addition, the tangential loading component 37*c* acting on the abrasive coating 14 on the opposite side of the concave bonding surface 26 will be framed by end wall 16, thereby reducing the effects of increased shear forces 38*c*. Thus, the tendency for coating 14** to shear will be reduced.

It will be clear to those skilled in the art that the present invention is not limited to the specific embodiments described and illustrated herein. Nor is the invention limited to turbine or compressor blades. Rather, the invention applies equally to any blade rotating relative to a circumferentially disposed fixed surface.

It will be understood that the dimensions and proportional and structural relationships shown in these drawings are illustrated by way of example only and those illustrations are not to be taken as the actual dimensions or proportional structural relationships used in the blade tip of the present invention.

Numerous modifications, variations, and full and partial equivalents can be undertaken without departing from the invention as limited only by the spirit and scope of the appended claims.

What is desired to be secured by Letters Patent of the United States is the following.

What is claimed is:

1. In a rotor blade which is rotatable with respect to a stationary surface, an improved blade tip with an abrasive coating bonded thereto at a bonding surface, said tip having a contour which is effective for providing a wearing surface if said tip contacts said stationary surface while rotating, wherein the area of said wearing surface is less than the area of said bonding surface, thereby reducing the resulting shear force per unit area in said abrasive coating along said bonding surface.

2. In a rotor blade with a radially outer end, a blade tip comprising:

an end wall, with an abrasive coating, extending radially outwardly from the perimeter of said outer end; and a concave surface, with an abrasive coating, bounded by said end wall and extending radially inwardly therefrom.

3. In a rotor blade with a radially outer end and an internal fluid passage, a blade tip comprising:

an end wall, with an abrasive coating, extending radially outwardly from the perimeter of said outer end and terminating in a generally flat surface; and a concave surface, with an abrasive coating, bounded by said end wall, and extending radially inwardly therefrom.

4. A blade tip, as recited in claim 3, further comprising:

a conduit for conducting a portion of said fluid from said passage through said end wall.

5. A blade tip, as recited in claim 3, further comprising:

a conduit for conducting a portion of said fluid from said passage through said flat surface.

6. A blade tip, as recited in claim 5, wherein said conduit defines a direction which is nearly normal to said flat surface.

* * * * *